US005413298A

United States Patent [19]

Perreault

[11] Patent Number: 5,413,298

[45] Date of Patent: May 9, 1995

[54] DOOR FRAME MOUNT FOR SWING

[76] Inventor: Ronald Perreault, 13, route Montmartre, Lamartre, Quebec, Canada, G0E 2H0

[21] Appl. No.: 60,967

[22] Filed: May 14, 1993

[51] Int. Cl.[6] ..... A47B 96/06

[52] U.S. Cl. ..... 248/228; 248/231.4; 248/231.7; 472/118

[58] Field of Search ..... 248/228, 225.31, 231.4, 248/231.5, 333, 231.7, 202.1, 214, 274; 472/118, 125

[56] References Cited

U.S. PATENT DOCUMENTS

| | | | |
|---|---|---|---|
| 995,411 | 6/1911 | Morrill | 248/231.5 |
| 1,225,567 | 5/1917 | Bongiovanni | 248/231.7 X |
| 1,369,747 | 2/1921 | Jordan | 248/231.7 X |
| 1,408,301 | 2/1922 | Jeter | 248/228 |
| 1,493,913 | 5/1924 | Whiteside | 248/228 |
| 1,536,361 | 5/1925 | Tomes | 248/228 |
| 1,821,488 | 9/1931 | Wetherbee | 248/231.2 X |
| 2,568,233 | 9/1951 | Hamilton | 248/228 X |
| 4,101,061 | 7/1978 | Sage et al. | 248/231.4 X |

FOREIGN PATENT DOCUMENTS

| | | | |
|---|---|---|---|
| 190021 | 10/1963 | Sweden | 472/118 |

*Primary Examiner*—Ramon O. Ramirez
*Assistant Examiner*—Korie H. Chan
*Attorney, Agent, or Firm*—Pierre Lespérance; Francois Martineau

[57] ABSTRACT

The mount is installed to the top horizontal segment of the door frame. The swing hangs from the mount by at least two cords. The mount includes two U-shape clamp frames, each having a first leg engaging vertical walls on opposite sides of the door frame top segment, and a second leg telescopically engaged into one another. Reciprocating motion of the two clamps one relative to the other is controlled by an endless screw shaft, the shaft being actuated by a handle. A pair of tilt-controlling arms are provided about the web of the corresponding clamps, adjacent their telescopic legs, to engage the bottom edge of the door frame top segment so as to prevent mount tilt during swinging motion of the swing.

1 Claim, 5 Drawing Sheets

78
24a
106
30
112
110a
12a
25
94
130
9
112

110a
111
115a
113
119
121
123
117
108

106
130
112
12
12a
78
94
108
120
12b
54
68
30
130
112

8
8
110a
110b
108
30
109
120
110b
110a

DOOR FRAME MOUNT FOR SWING

FIELD OF THE INVENTION

This invention relates to swings for use inside a dwelling.

BACKGROUND OF THE INVENTION

U.S. Pat. No. 1,369,747 issued in 1921 to Thomas JORDAN, discloses a swing, consisting of a seat member 8 hanged to the horizontal top segment 4 of a door frame 1 by flexible suspenders 7. Each suspender 7 is connected to the door frame by a distinct C-shape clamp 6.

Canadian patent No. 549,839 issued in 1957 to Charles LAVOIE discloses a swing consisting of a seat 15 hanged to an H-shape mount 1 by suspenders 10, 12, 14. H-mount 1 is anchored to a ceiling 4 with a bolt 3 extending through central part 2 of mount 1.

A drawback in these prior art swing mounts is that, although generally satisfactory, they tend to loosen their anchoring under the strain of the continuous swinging motion of the seat. Indeed, this swinging load applies a translational bias to the swing mount, which often leads to progressive release (with time) of the mount—a safety hazard.

OBJECTS OF THE INVENTION

A general object of the invention is to improve upon existing indoor swings.

A more particular object of this invention is to provide such an indoor swing, having a wall mount which will resist much better than the other swing mounts the progressive loosening of the wall anchoring under the continuous load sustained with time by the swing.

SUMMARY OF THE INVENTION

According to the invention, there is disclosed a swing mount assembly for mounting a swing to the top segment of a door frame, said swing being of the type comprising seat means and flexible suspender members for hanging said seat means to said mount assembly freely over ground whereby said seat means are reciprocatable through the aperture defined by said door frame, said door frame defining first and second opposite faces, said mount assembly consisting of: (a) a first abutment member, for releasably abutting an upper portion of said first face of said door frame top leg; (b) a second abutment member, for releasably abutting an upper portion of said second face of said door frame top leg; (c) a third abutment member, for releasably abutting a lower portion of said first face of said door frame top leg; (d) a fourth abutment member, for releasably abutting a lower portion of said second face of said door frame top leg; (e) a main frame, operatively interconnecting said first to fourth abutment members; (f) biasing means, for biasing said first and third abutment members against said door frame first face and said second and fourth abutment members against said door frame second face; (g) means for securing said suspender members to said main frame; and (h) joint means for relative movement of said third and fourth abutment members relative to said main frame, said joint means responsive to the swinging motion of said seat means to accordingly tilt said third and fourth abutment members against said door frame while insulating said first and second abutment members from this motion load.

BRIEF DESCRIPTION OF THE DRAWINGS

FIG. 9, on the fourth sheet of drawings, is a view at an enlarged scale of the area circumscribed by arrow 9 in FIG. 6.

DETAILED DESCRIPTION OF THE INVENTION

Figure 1:
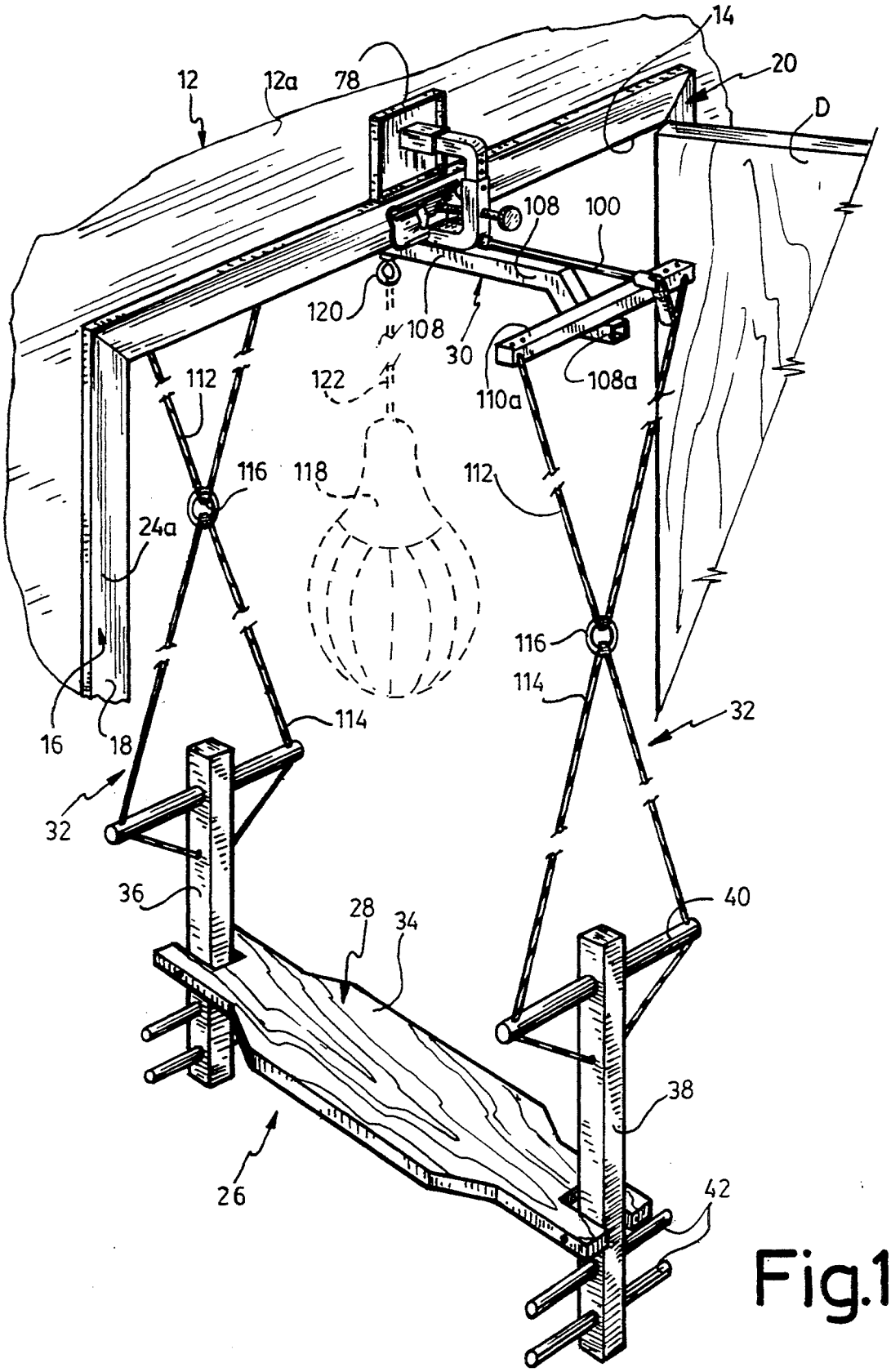
FIG. 1 is a perspective view of a first embodiment of the indoor swing, being mounted to a door frame shown fragmentarily, a punching bag depending from the swing mount being also shown in phantom lines.

The upright wall 12 of the house (not shown) defines a door opening 14 circumscribed by a conventional door frame 16. Door opening 14 is a through-way between two rooms in the house, wherein first and second opposite faces 12*a*, 12*b*, of wall 12 are defined. Door frame 16 includes two vertical legs 18, 20, extending downwardly to the flooring (not shown), and a top horizontal leg 22. Each leg 18–22 defines first and second opposite faces 18*a*/18*b*, 20*a*/20*b*, 22*a*/22*b*, (merging with faces 12*a* and 12*b*, respectively) and a pair of opposite finishing planks 24*a*, 24*b*, one on each face 12*a*, 12*b* of wall 12 edgewisely of the door frame legs 18–22. Finish planks 24*a*, 24*b*, project outwardly from the plane of the room wall faces 12*a*, 12*b*, wherein an offset 25 (FIG. 6) is defined therebetween. Door frame 16 may hingedly support a pivotal door D along one side leg thereof, 20.

The indoor swing 26 consists of a seat member 28, a mount means 30 releasably anchored to the top leg 22 of the door frame 16, and flexible suspender members 32 for hanging the seat member 28 to the mount means 30 freely over the flooring. The mount means 30 enables the suspenders 32 to reciprocate the seat 28 through the door aperture 14, from the first to the second room, and vice versa. This reciprocating or swinging motion of the seat 28 is initiated by the infant sitting thereon and pushing with his feet on the floor to bias the seat through the door aperture 14, as is well known.

Two embodiments of seat members 28 are envisioned. The first seat member 28, illustrated in FIG. 1, is of the see-saw type, with an elongated plank 34, oriented generally orthogonally to the plane of the door aperture 14 and extending through the latter, and two transverse posts 36 and 38, pivotally mounted at the opposite ends of the plank 34 for pivotal motion within the plane of the plank 34. Each post 36 or 38 carries top and bottom transverse handles 40, 42, for hand and foot grasping respectively by the infant.

Figure 2:
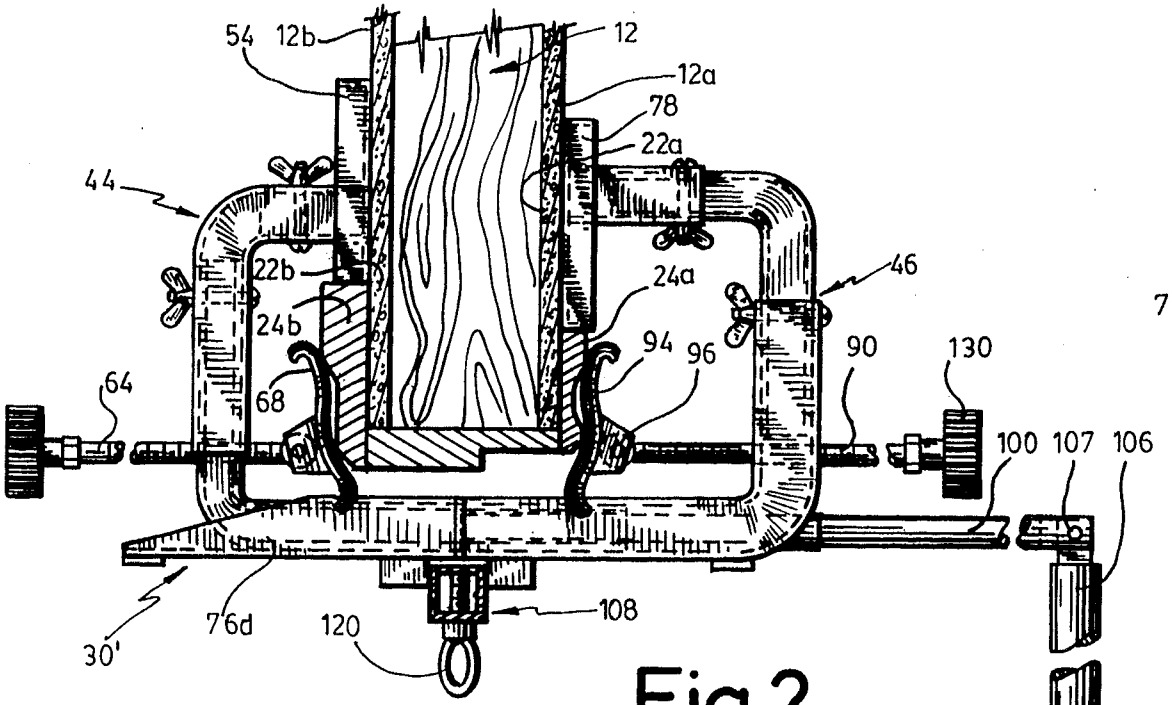
FIG. 2 is an enlarged cross-section about line 2—2 of FIG. 1*a;*
Figure 4:
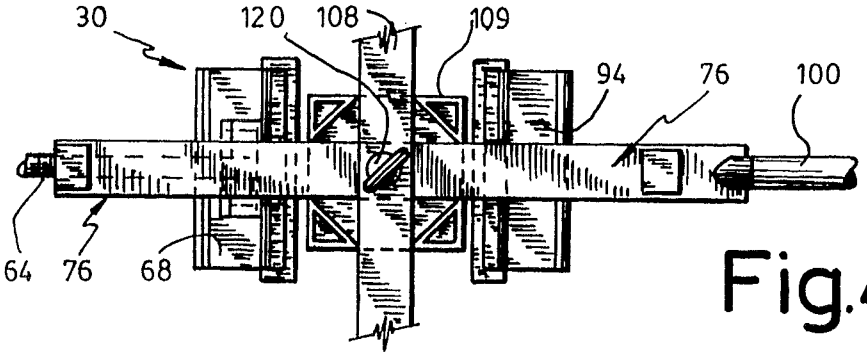
Figures 2A, 6, 7, 8:
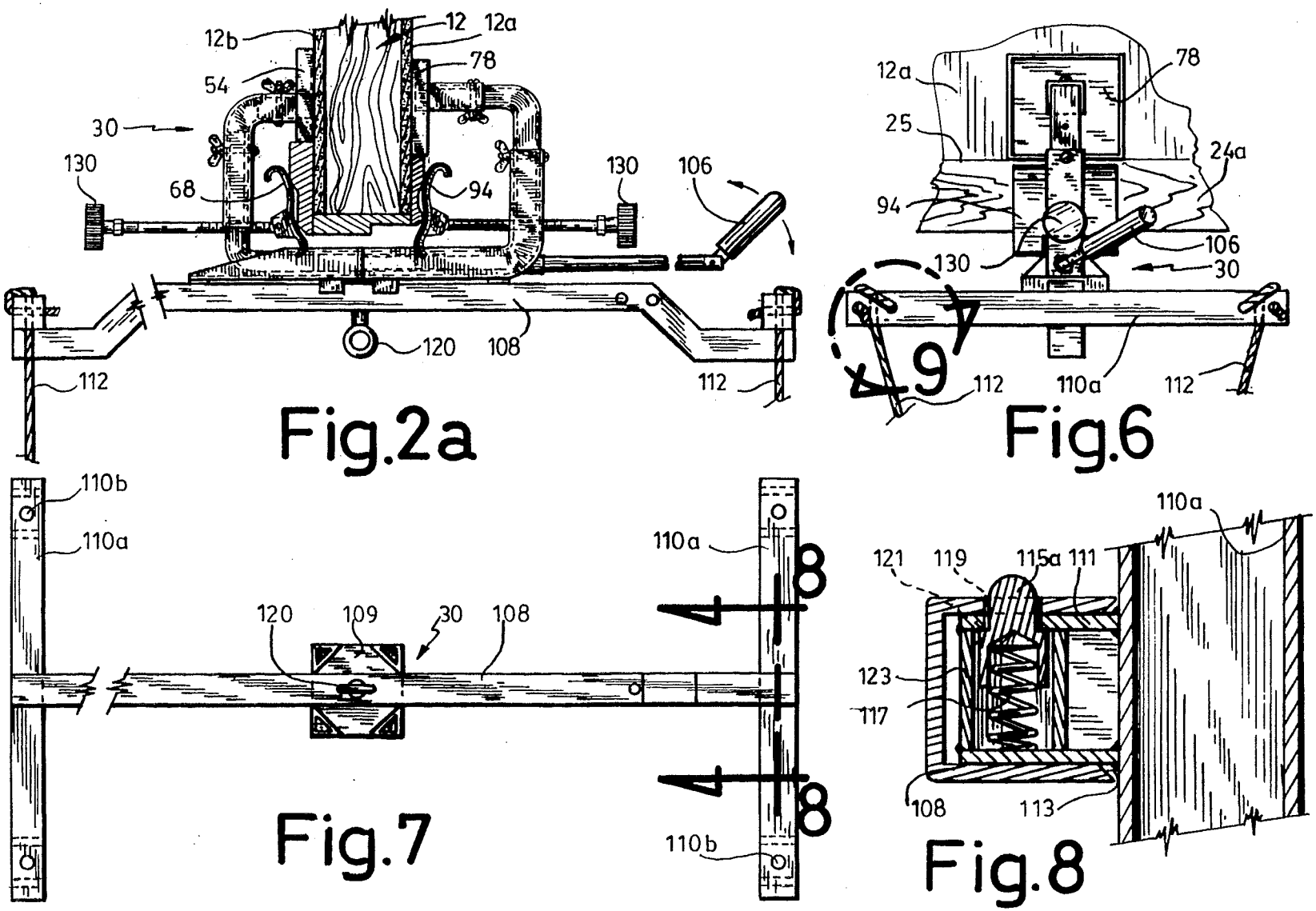
FIG. 2*a*, on the fifth sheet of drawings, is a view similar to but at a smaller scale than FIG. 2, but relating to the first embodiment illustrated in FIG. 1.
FIGS. 6 and 7 ate a front elevation and a bottom plan view, respectively, of the mount elements and door frame top segment of FIG. 2*a;*
FIG. 8 is an enlarged cross-section about line 8—8 of FIG. 7.
Figure 5:
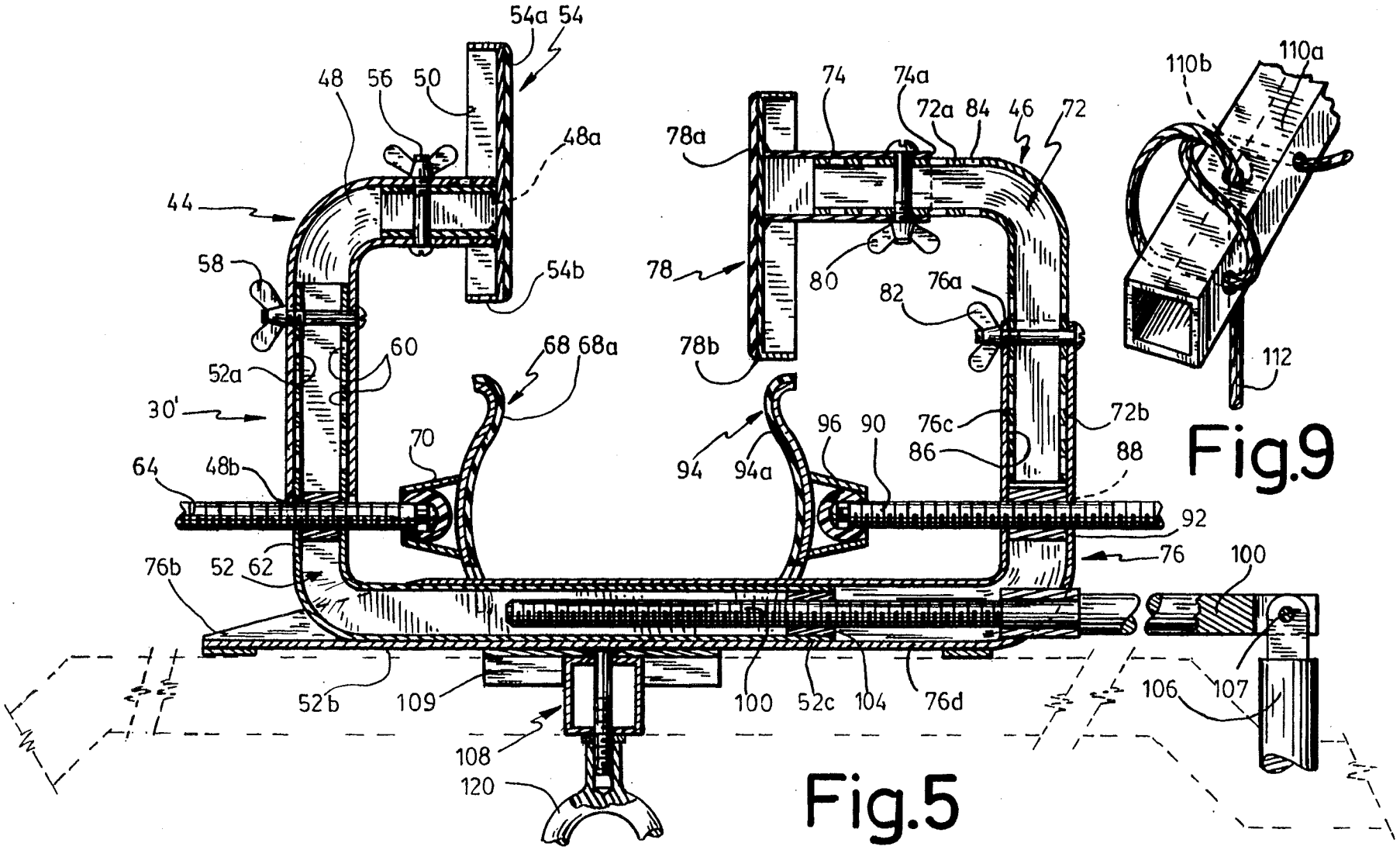
FIG. 5 is an enlarged cross-section about line 5—5 of FIG. 3.

The mount means 30 is detailed in FIGS. 2, 2*a* and 5. According to the invention, the mount means 30 includes a pair of generally C-shape, tubular members 44, 46, telescopically mounted to one another. More particularly, C-member 44 includes a first, L-shape, tubular section 48, having opposite female-type coupling end mouths 48*a*, 48*b*; a second, straight, tubular section 50, engaging through said first section end mouth 48*a*; and a third L-shape tubular section 52, having one leg 52*a* extending through said first section end mouth 48*b* and another leg 52*b*. Second tubular section 50 carries an integral transverse pad 54 at its outer end. Quadrangular pad 54 defines a main flat surface 54*a*, and a peripheral edge portion 54*b* orthogonal to main surface 54*a*. The pad main surface 54*a* is destined to operatively abut against wall surface 12*b*, while the bottom leg of the peripheral edge portion thereof, 54*b*, will abut against the top edgewise portion of the corresponding portion of finish plank 24*b* within the recess defined by offset 25. A locking wingnut 56 releasably interconnects tubular sections 48 and 50 at a fixed extended position of section 50; while tubular sections 48 and 52*a* are interconnected by another locking wingnut 58 at an adjustably selected extended position of section 52*a* (section 52*a* includes a set of lengthwisely spaced, small through-bores 60 for that purpose). L-shape leg 52*a* further includes a large through bore 62, proximate its elbow and exteriorly of tube 48, being engaged by a threaded shaft 64. A nut 66 is engaged inside the hollow of tube 52*a*, in register with bore 62 for threaded engagement by shaft 64. Shaft 64 carries at its inner end another pad 68 through a knee joint 70. Pad 68 defines a smooth wavy surface 68*a* destined to generally conform adjustably to and abuttingly engage with the corresponding portion of finishing plank 24*b*.

C-shape member 46 includes a first, L-shape, tubular section 72, having opposite male-type coupling, first and second end portions 72*a*, 72*b*; a second, straight, tubular section 74, defining a mouth 74*a* being engaged by said first section end portion 72*a*; and a third L-shape tubular section 76, having first and second opposite mouths 76*a* and 76*b* at the ends of two legs 76*c* and 76*d*, respectively. Mouth 76*a* is engaged by the first tube end portion 72*b*, while mouth 76*b* is engaged by tubular leg 52*b* of the C-shape member 44, wherein tubes 76 and 52 of C-shape members 46 and 44 respectively are telescopingly engaged. Second tubular section 74 carries an integral transverse pad 78 at its outer end. Quadrangular pad 78 defines a main flat surface 78*a*, and a peripheral edge portion 78*b* orthogonal to main surface 78*a*. The pad main surface 78*a* as destined to operatively abut against wall surface 12*a*, while the bottom leg of the peripheral edge portion thereof, 78*b*, will abut against and be supported by the top edgewise portion of the corresponding finish plank 24*a* within the recess defined by offset 25. Accordingly, top finishing plank 24*a* (in register with the top horizontal leg 22 of the door frame 16) prevents the C-clamp 46 from slidingly disengaging downwardly from the door frame, even if the anchoring force exerted by the friction fit locking engagement between the C-clamp 46 and the vertical wall 12*a* is relatively small. As suggested in FIGS. 2 and 2*a*, the top segments of finish planks 24*a* and 24*b*, may be vertically offset relative to one another, whereby the pads 54 and 78 would accordingly be offset relative to one another with respect to their integral joint with shafts 50 and 74.

A locking wingnut 80 releasably interconnects tubular sections 72*a* and 74 at an adjustably selected extended position of section 50; while tubular sections 72 and 76 are releasably interconnected by another locking wingnut 82 at an adjustably selected extended position of section 72 (section 72 includes a set of lengthwisely spaced, small through-bores 84, 86, at the opposite end portions thereof, for that purpose). L-shape leg 76 further includes a large through bore 88, proximate its elbow and exteriorly of tube 72, being engaged by a threaded shaft 90. A nut 92 is engaged inside the hollow of tube 72, in register with bore 88 for threaded engagement by shaft 90. Shaft 90 carries at its inner end another pad 94 (similar to pad 68) through a knee joint 96. Pad 94 defines a smooth wavy surface 94*a* destined to generally conform adjustably to and abuttingly engage with the corresponding portion of finishing plank 24*a*.

The male-female end couplings between the various tubular elements of C-shape members 44 and 46, as above-disclosed, should be complementary, i.e. that the inner diameter of the female part of each coupling be approximately equal to the external diameter of the male part. This will allow free and smooth sliding displacement of the male part through the hollow of the female part, without introducing tilt play which would undesirably occur if the male part were diametrally much smaller than the female part lumen.

A threaded actuating rod 100 is engaged through an aperture 102 in the elbow of L-shape tube 76, axially into the hollow of tube leg 76*d*, through and into the hollow of tube leg 52*b*. Within the mouth portion 52*c* of tube 52 is fixedly carried a nut 104, this nut being threadedly engaged by actuating rod 100. To the outer end of rod 100 is pivotally carried a transverse actuating handle 106.

The bottom face of tube part 76*d* integrally carries a bar member 108 (via a lock plate 109) for supporting the suspenders 32. In the embodiment of FIG. 1, bar member 108 extends through the door aperture 16, and comprises downwardly offset, opposite end portions 108*a*, 108*a*, which support corresponding transverse, rigid, integral legs 110*a*, 110*a*. As illustrated, transverse leg 110*a* advantageously constitutes an abutment supporting surface for the outer end portion of (horizontally extending) actuating rod 100. The two ends of each transverse leg 110*a*, 110*a* are interconnected by a flexible cord 112, the cords 112 being much longer than the length of these legs 110*a*, 110*b*, so that their intermediate sections hangs freely beneath these legs. Each loop cord 112 is connected to another corresponding, flexible, loop cord 114, via a rigid ring 116. Alternately, rings 116 are replaced by a locking knot arrangement, not illustrated. Loop cord 114 interconnects the two opposite ends of transverse arm 40 at a corresponding end of the see saw, whereby associated cords 112 and 114 form an X-shape assembly, as illustrated. Cord 114 may further extend downwardly from each end of arm 40, to merge about post 38. A punch bag 118, shown in phantom lines in FIG. 1, may be hung to a hook 120 at the intermediate section of bar member 108, by a cord 122.

Figure 1A:
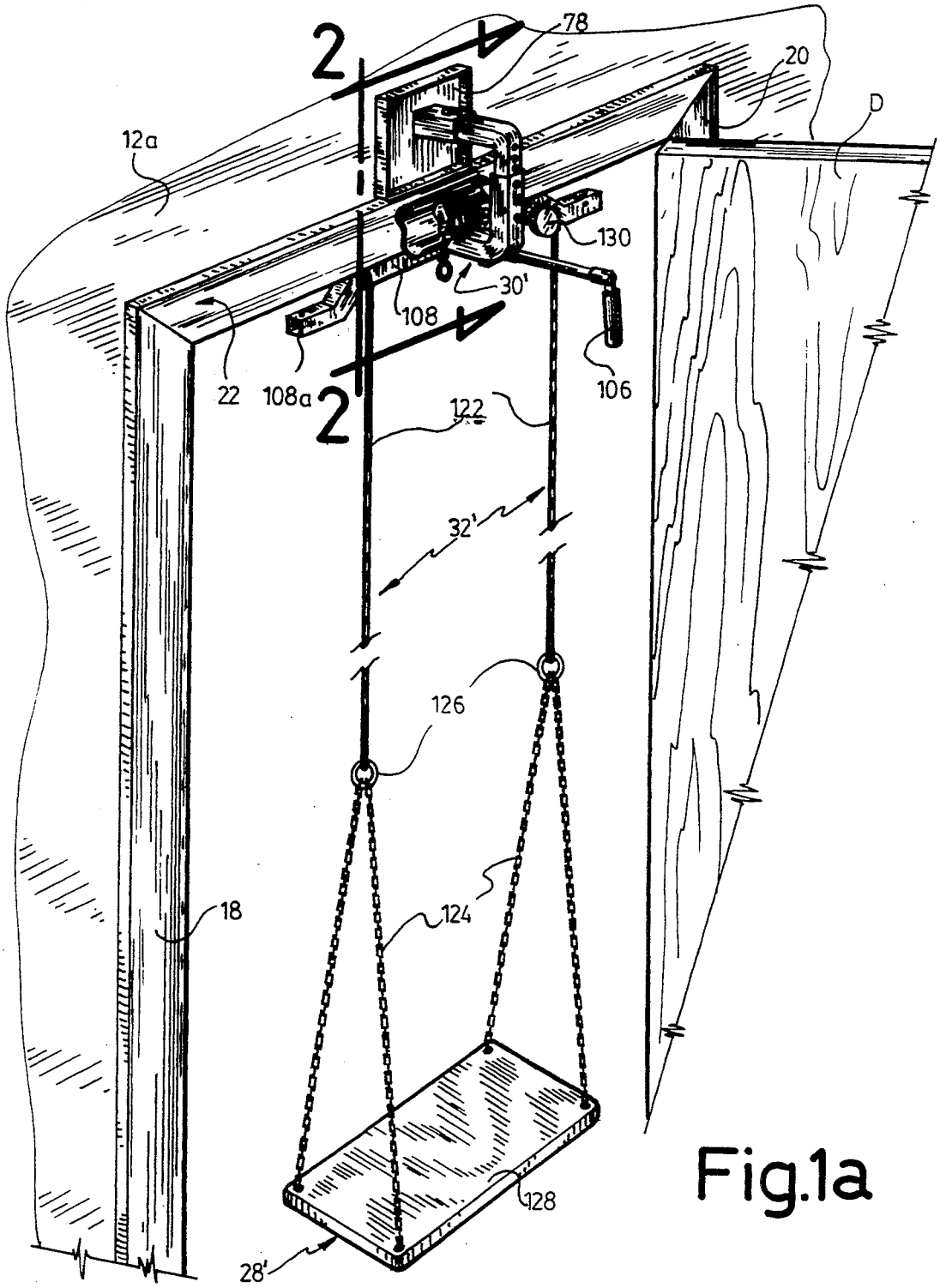
FIG. 1*a* is a view similar to FIG. 1, but showing the second embodiment of the invention.
Figure 3:
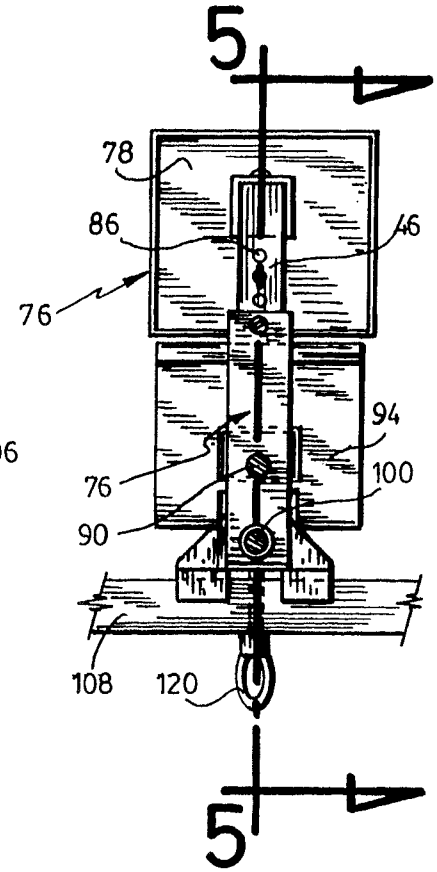
FIGS. 3 and 4, on the third sheet of drawings, are a front elevation and bottom plan view respectively of the swing mount elements and door frame top segment of FIG. 2.

As suggested in FIG. 8, each bar 110*a* at the respective ends of the main bar 108 is preferably releasably connected thereto, whereby the H-shape bar assembly 108, 110*a*, 110*a*, (of the see-saw embodiment of FIG. 1) can be disassembled so that only bar 108 will remain, to constitute the swing of FIG. 1*a*. One way of releasably interconnecting bar 108 to one bar 110*a* consists in having an integral transverse box-like projection 111 from bar 110*a* engage an aperture 113 made in bar 108; a finger 115 is lodged inside the hollow of projection 111 and is biased by a spring 117 toward registering bores 119 and 121 made in the wall of projection 11 and bar 108. Finger 115 is diametrally larger than bores 119 and 121, but includes a nipple 115*a* being diametrally smaller relative to these bores. Hence, nipple 115*a* is spring biased to engage bores 117 and 119, when the bars 108 and 110*a* are positioned to make the bores register with one another, so these two bars become interlocked. To release the lock 115, one needs only to push nipple 115*a* into housing 111, against the bias of spring 117, and pull bar 110*a* away from bar 108. Preferably, the finger 115 and spring 117 combination is contained within a narrow housing 123 located within and being an integral part of box-like projection 111, to prevent nipple 115 from diverting laterally into the hollow of housing 111.

As suggested in FIG. 9, cord 112 may be releasably secured to tubular bar 110*a*, e.g. by having the cord end engage a series of through bores 110*b* therein and knotting same thereabout.

In the embodiment of FIG. 1*a*, bar member 108 extends within the plane of the door aperture 16, and again comprises downwardly offset, opposite end portions 108*a*, 108*a*. Each of the two intermediate portions of the bar member 108 located slightly short of the end portions thereof 108*a*, 108*a*, support a flexible cord 122, so that they hang freely beneath the bar member 108. Each cord 122 is connected to a further corresponding, flexible, loop cord 124, via a rigid ring 126. Each loop cord 124 is anchored at its bottom end to a corresponding end of a rectangular plate 128, plate 128 constituting seat 28'. A conventional, basic "swing" is then obtained.

It can now be understood how the mount means 30 or 30' may be installed on the top leg 22 of the door frame. First, pad 54 of C-clamp 44 is applied against wall 12*b*, above finish strip 24*b*, and then leg 52*a* is telescopingly extended from tube 48 until leg 52*b* clears the bottom edge of finish strip 24*b*, wherein nut 58 is screwed at the selected position to anchor tubes 48 and 50 together. Then, the height of tube 72 of the other C-clamp 46 is extended until pad 78 clears the corresponding finish strip 24*a*, and nut 82 is screwed at the selected position to interlock tubes 72 and 76. Tube 74 is extended to bring pad 78 flatly against wall 12*a*, wherein bolt 80 is tightened at the selected position to anchor tubes 72 and 74 to one another. The handle 106 pivoted at 107 to rod 100 is actuated to rotate threaded rod 100 to forcibly tighten pads 54 and 78 toward one another, against wall 12. Each of the two rods 64 are then actuated by rotating their corresponding control end knob 130 to bring pads 68 and 94 abuttingly against the lower section of finish strip 24*b* and 24*a*.

With such a swing mount construction, the undesirable progressive loosening of the anchoring of the mount 30 to the wall 12—which often occurs with prior art mounts due to the repetitive pendulum action applied thereto by the suspenders 32—is prevented with the present invention, due to:

(a) the generally closed frame arrangement obtained by telescopingly engaging the two C-shape members 44 and 46;

(b) the combination of a first pair of upper pads, 54 and 78, to a second pair of pads 68, 94, carried beneath the first one, the four pads engaging the two legs of the door frame;

(c) the provision of a knee joint 70, 96 for the lower pads 68, 94, respectively, which knee joints 70, 96, enable yielding action of the interconnected C-shape members 44, 46, during the swinging motion of the suspenders 32; that is to say, knee joints 70, 96, will allow the lower pads 68, 94, to slightly swing with the suspenders 32, while the upper pads 54, 78, are insulated from this swinging torque.

It is therefore understood that threaded rods 64, 90, provide continuous-type, fine adjustment capability in the adjustment of the distance between the two lower pads 68, 94, whereas bolt 80 provides only a coarse, incremental adjustment in the distance between the two upper pads 54, 78. Similarly, control rod 100 also provides fine, continuous-type adjustment capability of the overall length of telescoped tubes 52*b*, 76*d*, that is, also of the distance between the two lower pads 68, 94, cooperatively with the first fine adjustment means 64, 90, thus further enhancing the fineness of adjustment.

It is important that the fine adjustment be provided for the lower abutment pads 68 and 94, to provide optimum performance for the knee joint 70, 96, in tilting the lower pads 68, 94 responsively to the swinging load of the seat, while the upper pads 54, 78, are thereby insulated from this swinging load.

I claim:

1. A swing assembly adapted for mounting to a top segment of a door frame, said swing assembly comprising in combination:

a swing mount member, for anchoring to said door frame top segment;

seat means; and flexible suspender members, hanging said seat means to said mount member freely over a ground whereby said seat means are adapted to reciprocate through an aperture defined by said door frame, said door frame defining first and second opposite faces;

wherein said swing mount member consists of;

(a) a first L-shape tubular member defining first and second legs, said first leg thereof endwisely carrying a first transverse pad member for releasably abutting an upper portion of said first face of said door frame top leg, said second leg thereof defining an end mouth opening into the hollow of said first tubular member;

(b) a second L-shape tubular member, defining first and second legs, said first leg thereof endwisely carrying a second transverse pad member for releasably abutting an upper portion of said second face of said door frame top leg;

(c) a third L-shape tubular member, defining first and second legs, said first leg thereof defining an outer and an inner portion, said outer portion thereof being slidingly inserted through said mouth and into the hollow of said first tubular member second leg, said inner portion of said third tubular member transversely carrying a third pad member for releasably abutting a lower portion of said first face of said door frame top leg;

(d) a fourth L-shape tubular member, defining a first leg and a second elongated leg, said first leg thereof defining an outer and an inner portion, said outer portion thereof defining a mouth opening into the hollow of said outer portion of the fourth tubular member, said second leg of said second tubular member slidingly engaging through said mouth an into said hollow of said outer portion of said fourth tubular member first leg, said inner portion of the first leg of said fourth tubular member transversely carrying a fourth pad member for releasably abutting a lower portion of said second face of said door frame top leg, said second leg of the fourth tubular member defining a mouth opening into the hollow thereof, said second leg of said third tubular member slidingly engaging through said mouth and into said hollow of said second leg of said fourth tubular member;

(e) biasing means, for biasing said second leg of said third tubular member in sliding relative motion axially through the hollow of said second leg of said fourth tubular member;

(f) an elongated rigid support bar, anchored at an intermediate section thereof to said elongated second leg of said fourth tubular member and transversely extending relative thereto, said flexible suspended members being anchored at opposite ends of said elongated rigid support bar for swinging motion thereabout; and (g) knee joint means for relative movement of said third and fourth pad members relative to said third and fourth tubular members respectively;

wherein said knee joint means is responsive to the swinging motion of said seat means to accordingly tilt said third and fourth tubular members against said door frame while insulating said first and second tubular members from this motion load.

* * * * *